US010602797B2

(12) United States Patent
Lintaman

(10) Patent No.: US 10,602,797 B2
(45) Date of Patent: Mar. 31, 2020

(54) LENGTH-ADJUSTABLE SHOE

(71) Applicant: Chris Lintaman, Ontario (CA)

(72) Inventor: Chris Lintaman, Ontario (CA)

( * ) Notice: Subject to any disclaimer, the term of this patent is extended or adjusted under 35 U.S.C. 154(b) by 93 days.

(21) Appl. No.: 15/744,603

(22) PCT Filed: Jul. 27, 2015

(86) PCT No.: PCT/CA2015/050704
§ 371 (c)(1),
(2) Date: Jan. 12, 2018

(87) PCT Pub. No.: WO2017/015737
PCT Pub. Date: Feb. 2, 2017

(65) Prior Publication Data

US 2018/0199659 A1 Jul. 19, 2018

(51) Int. Cl.

| | |
|---|---|
| ***A43B 3/06*** | (2006.01) |
| ***A43B 3/26*** | (2006.01) |
| ***A43B 1/00*** | (2006.01) |
| ***A43B 23/04*** | (2006.01) |
| ***A43C 3/00*** | (2006.01) |
| ***A43C 11/14*** | (2006.01) |
| ***A43C 11/16*** | (2006.01) |
| ***A43C 11/20*** | (2006.01) |
| ***A43C 1/00*** | (2006.01) |
| ***A43C 1/06*** | (2006.01) |

(52) U.S. Cl.
CPC ..... *A43B 3/26* (2013.01); *A43B 1/0081* (2013.01); *A43B 3/06* (2013.01); *A43B 23/047* (2013.01); *A43C 1/00* (2013.01); *A43C 1/006* (2013.01); *A43C 1/06* (2013.01); *A43C 3/00* (2013.01); *A43C 11/146* (2013.01); *A43C 11/165* (2013.01); *A43C 11/20* (2013.01)

(58) Field of Classification Search
CPC .. A43B 3/06; A43B 3/242; A43B 3/26; A43C 1/006
USPC ..... 36/97, 105
See application file for complete search history.

(56) References Cited

U.S. PATENT DOCUMENTS 2,523,449 A * 9/1950 Rosenzweig ..... A43B 3/26 36/102
4,120,103 A * 10/1978 Colby ..... A43B 3/26 36/130

(Continued)

FOREIGN PATENT DOCUMENTS

CN 201436876 U 4/2010
CN 203040850 U 7/2013

(Continued)

*Primary Examiner* — Sharon M Prange
(74) *Attorney, Agent, or Firm* — Muncy, Geissler, Olds & Lowe, P.C.

(57) ABSTRACT

A length-adjustable shoe, of which a length between a front end and a rear end thereof is adjustable, includes an outsole, an upper, a stretch fabric, and a control device. The upper includes a body portion and a heel portion which are mutually separated, wherein the body portion is directly attached on the outsole, and the stretch fabric connects a bottom edge of the heel portion and the outsole. The control device connects the body portion and the heel portion, wherein the control device moves the heel portion relative to the body portion as a whole in an axial direction from the front end to the rear end, which changes the length of the shoe.

13 Claims, 10 Drawing Sheets

(56) References Cited

U.S. PATENT DOCUMENTS

| | | | | |
|---|---|---|---|---|
| 4,510,701 | A | 4/1985 | Schour et al. | |
| 5,408,761 | A | 4/1995 | Gazzano | |
| 5,771,608 | A | 6/1998 | Peterson | |
| 5,956,868 | A | 9/1999 | Stevens et al. | |
| 6,463,822 | B1 | 10/2002 | Bader et al. | |
| 7,055,268 | B2 * | 6/2006 | Ha | A43B 1/0018 36/51 |
| 7,685,747 | B1 * | 3/2010 | Gasparovic | A43B 3/30 36/101 |
| 7,793,438 | B1 * | 9/2010 | Busse | A43B 11/02 36/105 |
| 8,938,890 | B2 * | 1/2015 | Raghuprasad | A43B 3/26 36/55 |
| 9,095,188 | B2 * | 8/2015 | Cavaliere | A43B 7/14 |
| 9,144,262 | B2 * | 9/2015 | Ardell | A43B 5/06 |
| 9,392,838 | B2 * | 7/2016 | Fischer | A43B 5/1608 |
| 9,414,640 | B2 * | 8/2016 | Nichols | A43B 5/14 |
| 9,445,644 | B2 * | 9/2016 | Cressman | A43B 1/0054 |
| 9,516,920 | B1 * | 12/2016 | DeRose | A43B 3/26 |
| 9,795,187 | B2 | 10/2017 | Cavaliere | |
| 10,159,310 | B2 * | 12/2018 | Sullivan | A43B 23/0245 |
| 2004/0111921 | A1 | 6/2004 | Lenormand | |
| 2005/0055849 | A1 | 3/2005 | Ha | |
| 2008/0052960 | A1 | 3/2008 | Belley et al. | |
| 2008/0148600 | A1 | 6/2008 | Aveni et al. | |
| 2009/0229144 | A1 | 9/2009 | Sussman | |
| 2010/0319216 | A1 * | 12/2010 | Grenzke | A43B 11/00 36/54 |
| 2012/0198721 | A1 | 8/2012 | Cavaliere | |
| 2014/0123449 | A1 * | 5/2014 | Soderberg | A43C 1/003 24/712.1 |
| 2014/0259774 | A1 | 9/2014 | Minden | |

FOREIGN PATENT DOCUMENTS

| | | | |
|---|---|---|---|
| CN | 204426861 | U | 7/2015 |
| TW | M496944 | U | 3/2015 |
| TW | M512317 | U | 11/2015 |
| WO | WO2010011275 | | 1/2010 |
| WO | WO2012047405 | A1 | 4/2012 |

* cited by examiner

LENGTH-ADJUSTABLE SHOE

BACKGROUND OF THE INVENTION

1. Technical Field

The present invention relates generally to footwear, and more particularly to a length-adjustable shoe.

2. Description of Related Art

A pair of perfectly fit shoes would obviously enhance the performance of an athlete while doing certain kinds of sports activities, such as cycling, skiing, snowboarding, mountaineering, etc. However, putting on a pair of perfectly fit shoes is usually a little troublesome, because the bottom of a heel can easily get obstructed by the rear portion of a shoe collar. In addition, some kind of games may require contestants to change their shoes during the competition (e.g., triathlon), and therefore the time it takes to put on shoes may greatly affect the rankings in a tight game.

Hence, it would be preferable to have a shoe which can be easily and quickly put on, and can still perfectly fit the wearer's foot at the same time.

BRIEF SUMMARY OF THE INVENTION

In view of the above, the primary objective of the present invention is to provide a shoe, of which a length can be adjusted at will. The shoe can be put on easily, quickly, and "on the fly". In addition, the length adjusting can be done in a flash.

The present invention provides a shoe, of which a length between a front end and a rear end thereof is adjustable, wherein the front end and the rear end are two opposite ends of the shoe, and the front end is where toes of a wearer are toward, while the rear end is near a heel of the wearer when the wearer is in the shoe. The shoe includes an outsole, an upper, a stretch fabric, and a control device. The upper includes a body portion and a heel portion, which are separated from each other, wherein when the wearer is in the shoe, the body portion covers a bridge of a foot of the wearer, and the heel portion fits around the heel of the wearer; the body portion is directly attached on the outsole; the heel portion has a bottom edge. The stretch fabric connects the bottom edge of the heel portion and the outsole. The control device connects the body portion and the heel portion of the upper, wherein the control device moves the heel portion relative to the body portion as a whole in an axial direction from the rear end to the front end of the shoe, which makes the heel portion press against the heel of the wearer when the wearer is in the shoe.

Whereby, the shoe provided in the present invention can be easily put on. Furthermore, since the length of the shoe can be adjusted quickly at will, a pair of such shoes would perfectly fit the feet of a wearer.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
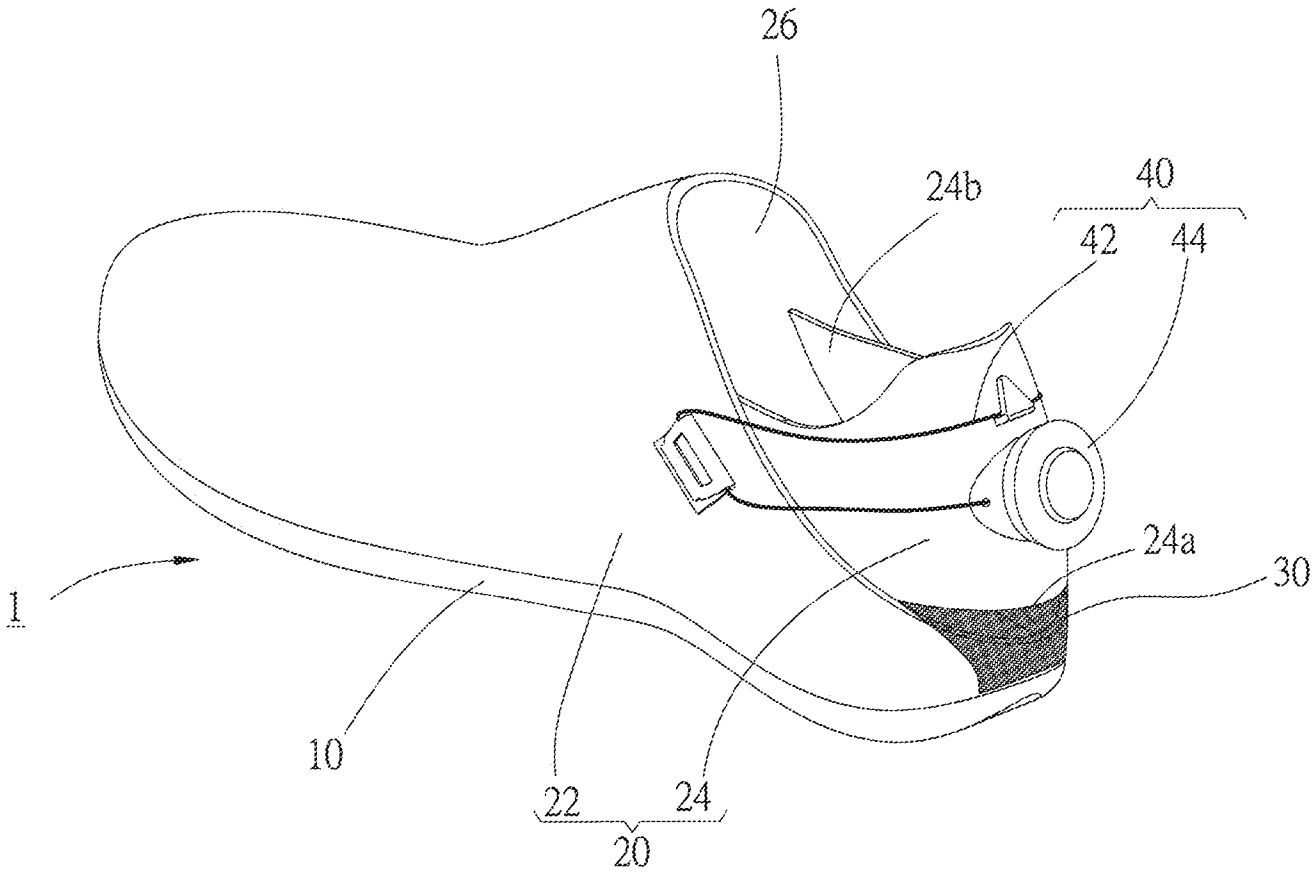
FIG. 1 is a perspective view of a first preferred embodiment of the present invention, showing the fastener of the control device is mounted on the heel portion.
Figure 2:
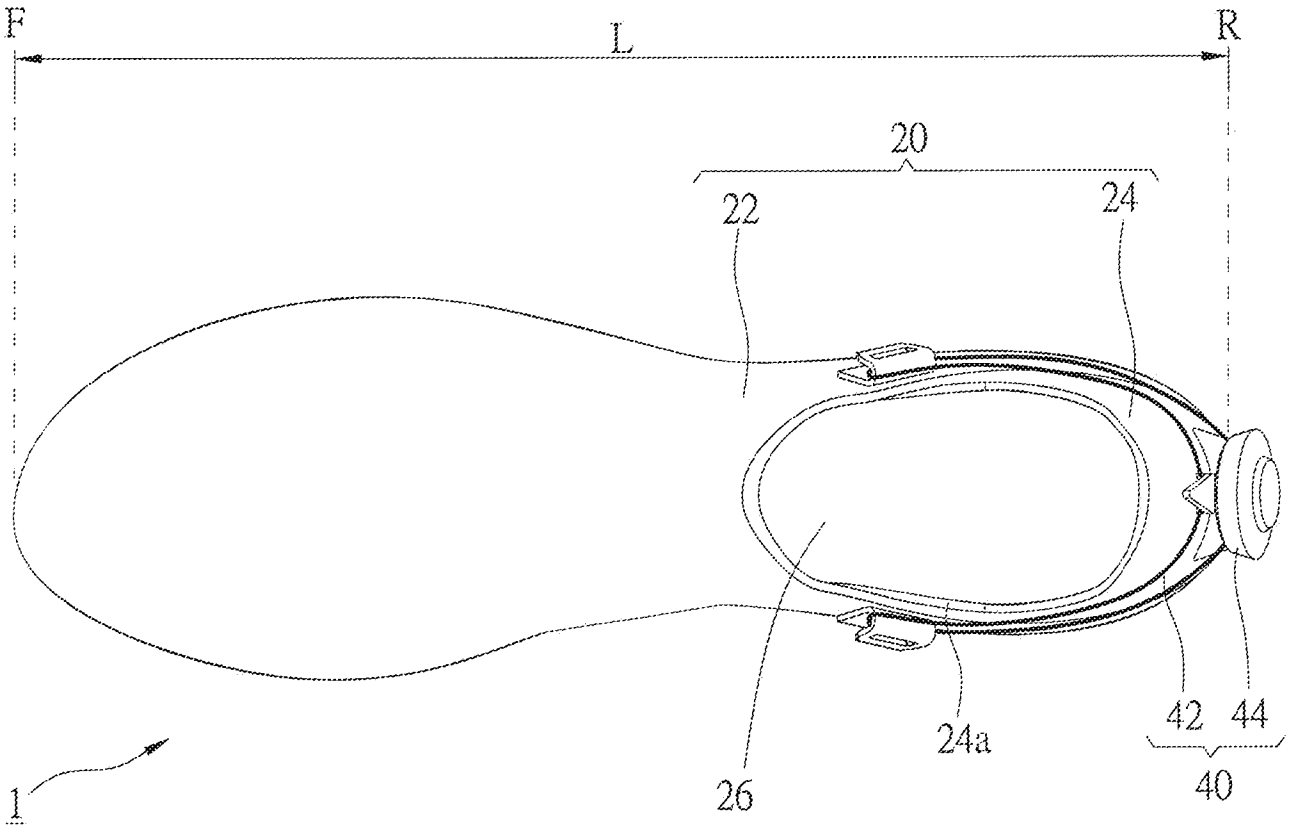
FIG. 2 is a top view of the first preferred embodiment of the present invention.
Figure 3:
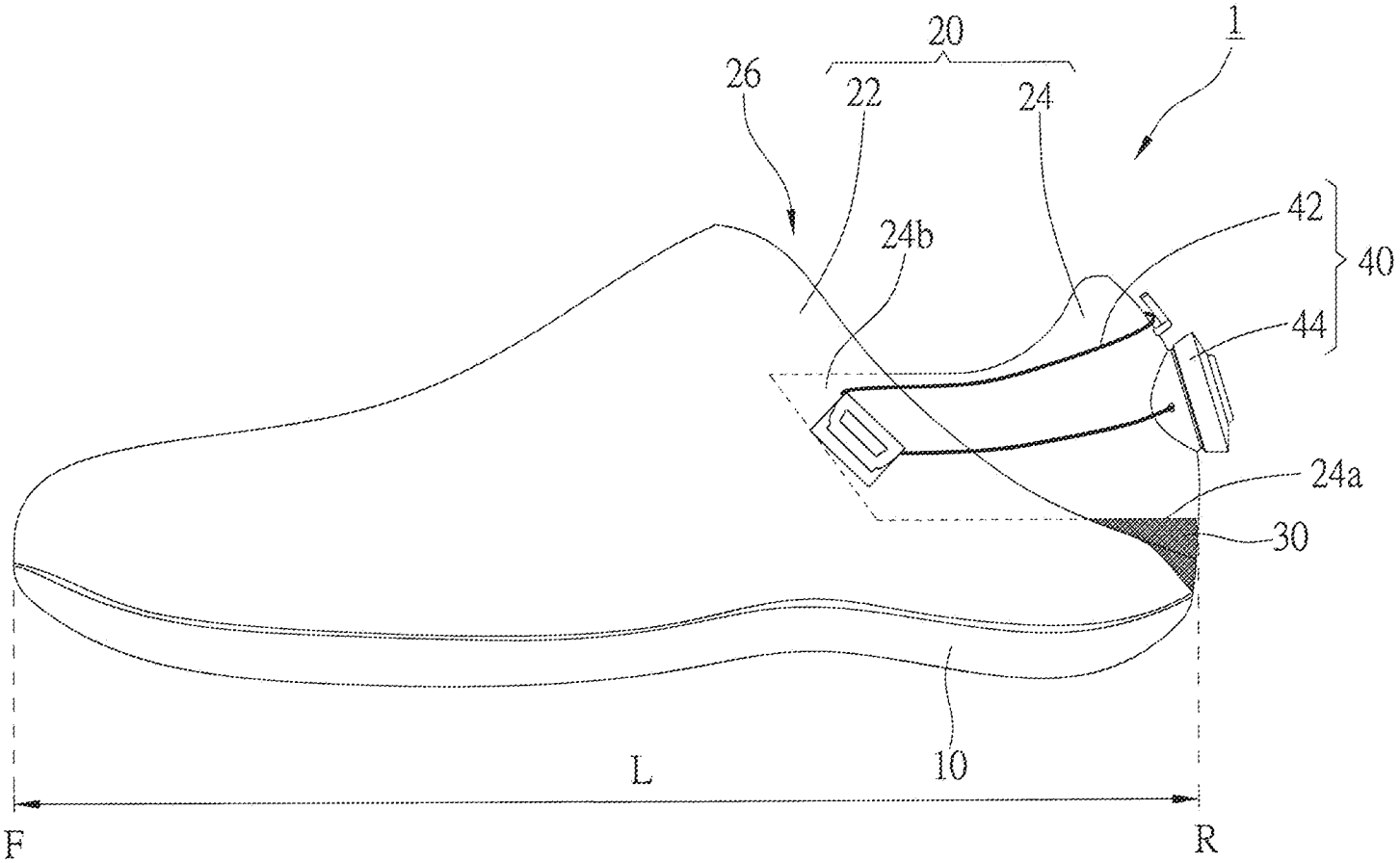
FIG. 3 is a side view of the first preferred embodiment of the present invention, showing the length between the front end and the rear end of the shoe is relatively extended.

As shown in FIG. 1 to FIG. 3, a shoe 1 of the first preferred embodiment of the present invention includes an outsole 10, an upper 20, a stretch fabric 30, and a control device 40. The upper 20 includes a body portion 22 and a heel portion 24, which are separated from each other, wherein the body portion 22 is directly connected on the outsole 10, and is adapted to cover a bridge of a foot of a wearer; the heel portion 24 is connected to the outsole 10 through the stretch fabric 30, and is adapted to fit around a heel of a wearer. More specifically, the heel portion 24 has a bottom edge 24*a*, and the stretch fabric 30 is connected to the bottom edge 24*a* and the outsole 10 respectively.

In the first preferred embodiment, the control device 40 includes a connecting member 42 and a fastener 44. As an example, the connecting member 42 is a cable, while the fastener 44 is a cable dial mounted on the heel portion 24. The connecting member 42 connects the body portion 22 and the fastener 44 on the heel portion 24, and can be pulled by adjusting the fastener 44 to move the heel portion 24 relative to the body portion 22. In more details, a capacity 26 is formed between the body portion 22 and the outsole 10 to accommodate a feet of a wearer, and the heel portion 24 has two arms 24*b* extending in a direction toward the capacity 26. By turning the fastener 44, the connecting member 42 can be pulled to consequently move the heel portion 24 relative to the body portion 22, and the two arms 24*b* are therefore also moved further into the capacity 26 to be overlapped by the body portion 22.

The shoe 1 is defined to have a front end F and a rear end R, which are two opposite ends of the shoe 1, as shown in FIG. 2. By definition, when a wearer is in the shoe 1, where the toes of the wearer are toward is the front end F, and the rear end R is near a heel of the wearer, especially referring to a point on the heel portion 24 which is most opposite to the front end F. With such definition, it can be easily understood that a length L of the shoe 1 is the distance between the front end F and the rear end R.

Figure 4:
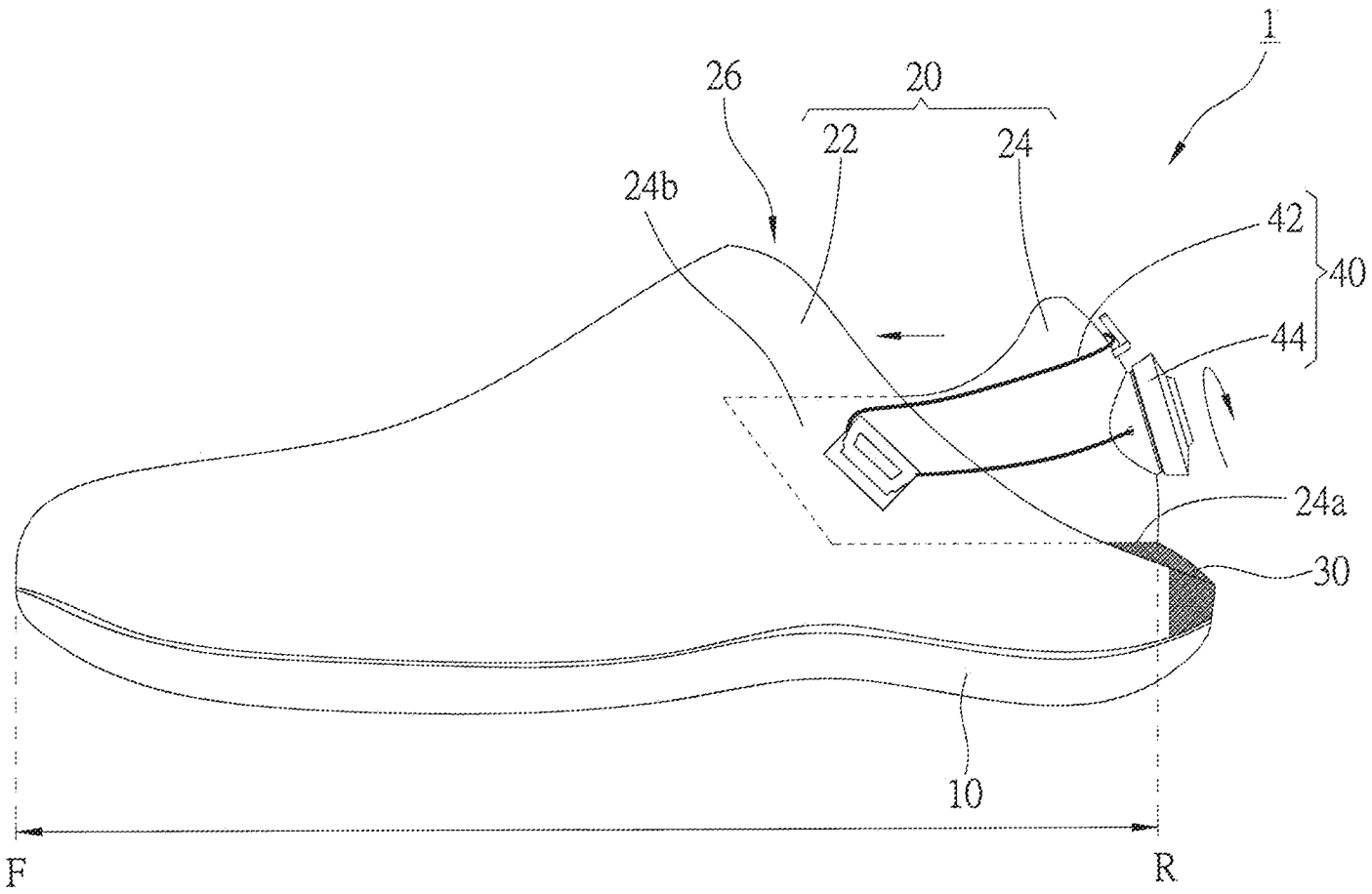
FIG. 4 is a side view of the first preferred embodiment of the present invention, showing the length between the front end and the rear end of the shoe is relatively shortened.

As shown in FIG. 4, when the fastener 44 is turned to pull the connecting member 42, the heel portion 24 is moved relative to the body portion 22 as a whole in an axial direction from the rear end R to the front end F of the shoe 1. As a result, the heel portion 24 presses against the heel of a wearer who is in the shoe 1. In comparison to FIG. 3, the length L shown in FIG. 4 is apparently shortened. With such design, the shoe 1 can be easily and quickly put on for one who has a slightly shorter foot than the shoe 1, for the heel portion 24 is separated from the body portion 22, and therefore would not hinder the action of putting the shoe 1 on. In addition, as mentioned above, once the shoe 1 is put on, a wearer is able to adjust the length L of the shoe 1 in a flash by simply turning the fastener 44 to make the shoe 1 perfectly fit his/her foot.

In practice, after putting on the shoe 1, a wearer can either slightly raise the heel and turn the fastener 44 to consequently move the heel portion 24 toward the body portion 22, or slightly raise the tiptoe and turn the fastener 44 to consequently move the body portion 22 toward the heel portion 24. Both ways can effectively adjust the length L of the shoe 1, and should be considered conceptually equivalent whether it's the heel portion 24 or it's the body portion 22 actually being moved. In other words, either way mentioned herein falls within the scope of the present invention.

Figure 5:
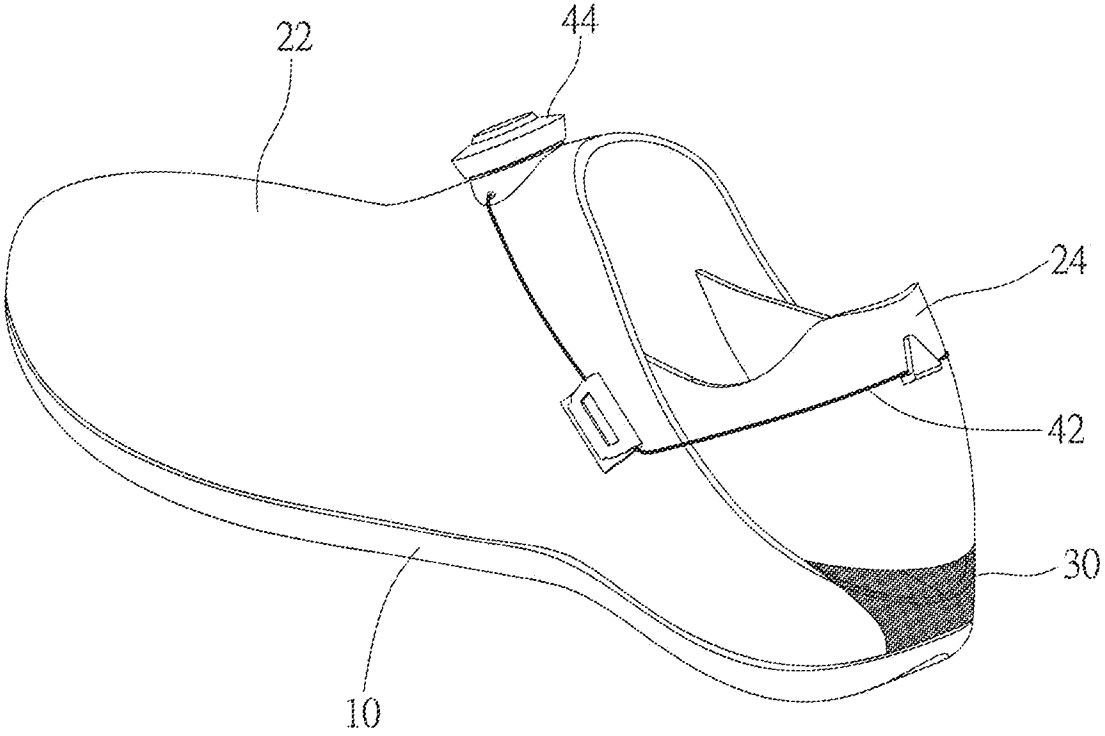
FIG. 5 is a perspective view of a second preferred embodiment of the present invention, showing the fastener of the control device is mounted on the body portion.
Figure 6:
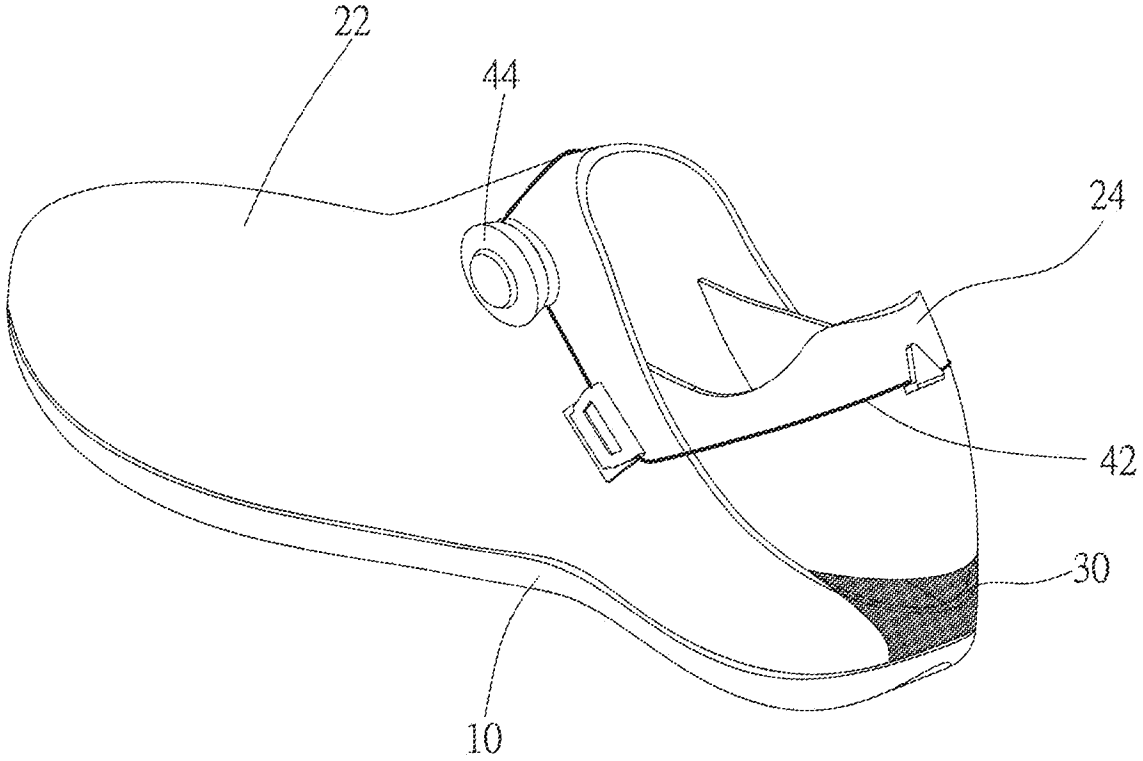
FIG. 6 is a perspective view of a third preferred embodiment of the present invention, showing the fastener of the control device is positioned at another location on the body portion.

In order to meet different requirements of use habits, the fastener 44 is not necessary to be always mounted on the heel portion 24. Here are two examples: the fastener 44 of a second preferred embodiment of the present invention is mounted on top of the body portion 22, as shown in FIG. 5, while the fastener 44 of a third preferred embodiment of the present invention is mounted on a side of the body portion 22, as shown in FIG. 6. Instead of connecting the fastener 44 and the body portion 22 as mentioned in the first preferred embodiment, the connecting member 42 of the second and the third preferred embodiments of the present invention connect the fastener 44 and the heel portion 24. The position of the fastener 44 (and the corresponding arrangement of the connecting member 42) is not a limitation of the present invention, as long as the fastener 44 is adapted to pull the connecting member 42 to move the heel portion 24 relative to the body portion 22.

Figure 7:
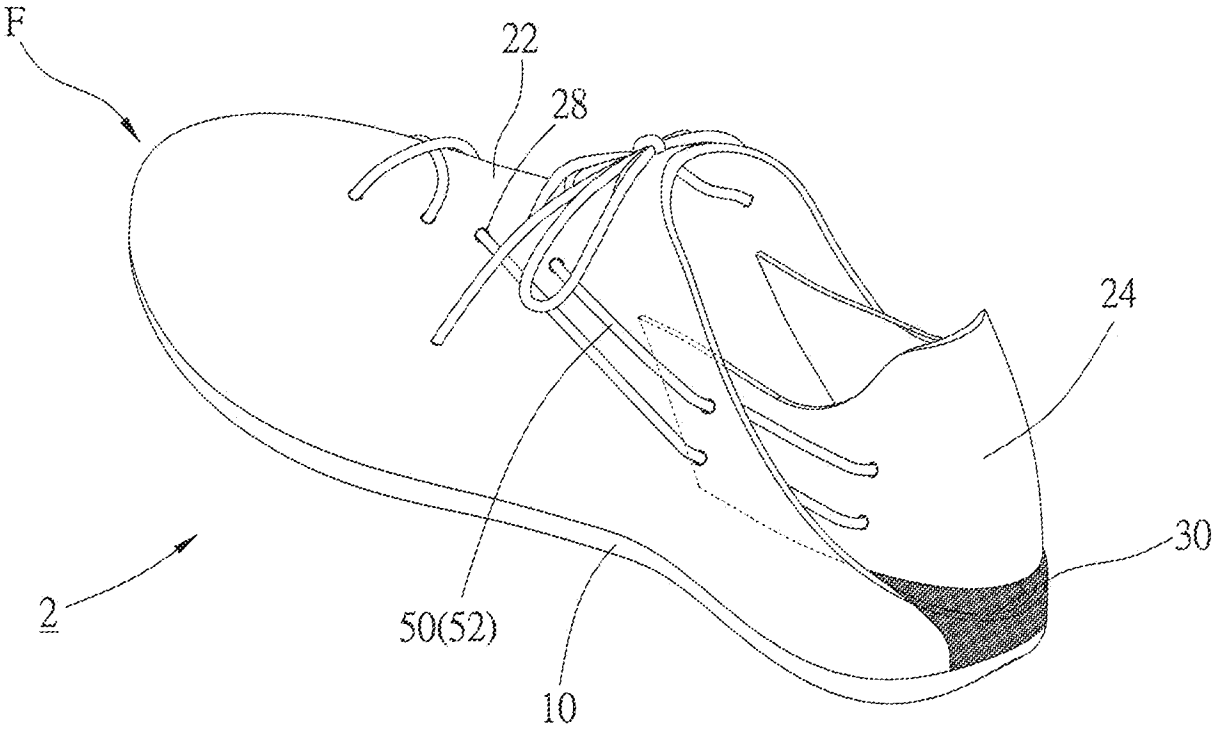
FIG. 7 is a perspective view of a fourth preferred embodiment of the present invention, showing the control device includes a shoe lace.
Figure 8:
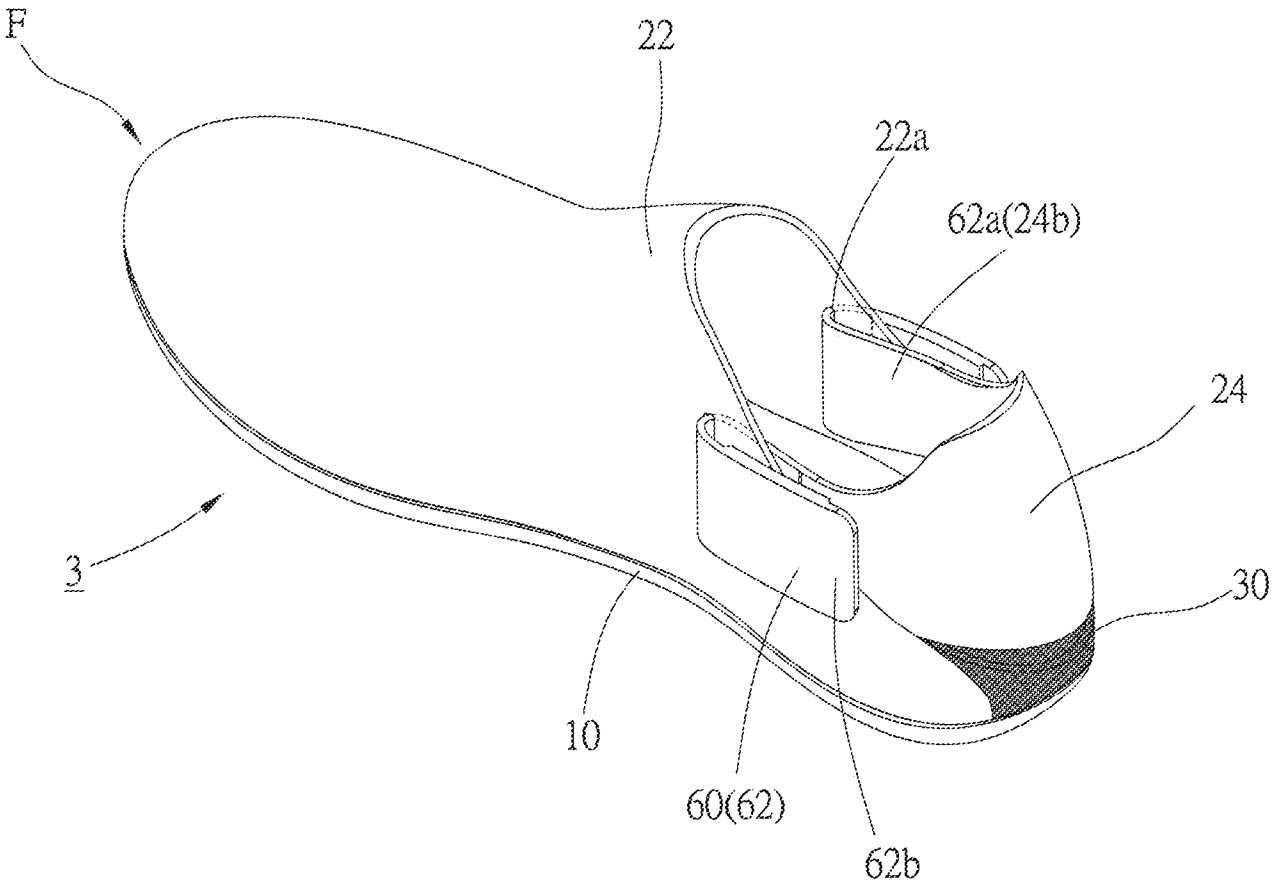
FIG. 8 is a perspective view of a fifth preferred embodiment of the present invention, showing the control device includes bands.

As shown in FIG. 7, a shoe 2 of a fourth preferred embodiment and the shoe 1 of the first preferred embodiment basically have the same structure, except that a control device 50 of the fourth preferred embodiment includes a shoe lace 52, and the body portion 22 and the heel portion 24 relatively have a plurality of perforations 28 thereon for the shoe lace 52 to thread through. With such design, the heel portion 24 of the shoe 2 of the fourth preferred embodiment can be also moved relative to the body portion 22 in the axial direction toward the front end F of the shoe 2 by pulling and tying the shoe lace 52. In this way, the length L of the shoe 2 can be adjusted as well.

Similarly, a shoe 3 of a fifth preferred embodiment of the present invention has approximately the same structure as mentioned in the previously introduced preferred embodiments, except that a control device 60 of the fifth preferred embodiment includes two bands 62, each of which has a first end 62*a* formed by one of the arms 24*b* of the heel portion 24, and has an opposite second end 62*b* passing through one of two slits 22*a* formed on the body portion 22, wherein each of the second ends 62*b* is adapted to be correspondingly affixed to one of the first ends 62*a*. Such design allows the bands 62 to be pulled to move the heel portion 24 relative to the body portion 22 in the axial direction toward the front end F of the shoe 3, and the length L of the shoe 3 can be adjusted as a result. In practice, the first ends 62*a* and the second ends 62*b* may be respectively provided with hook fasteners and loop fasteners, i.e. Velcro hooks and Velcro loops to affix each of the second ends 62*b* to one of the first ends 62*a*.

Figure 9:
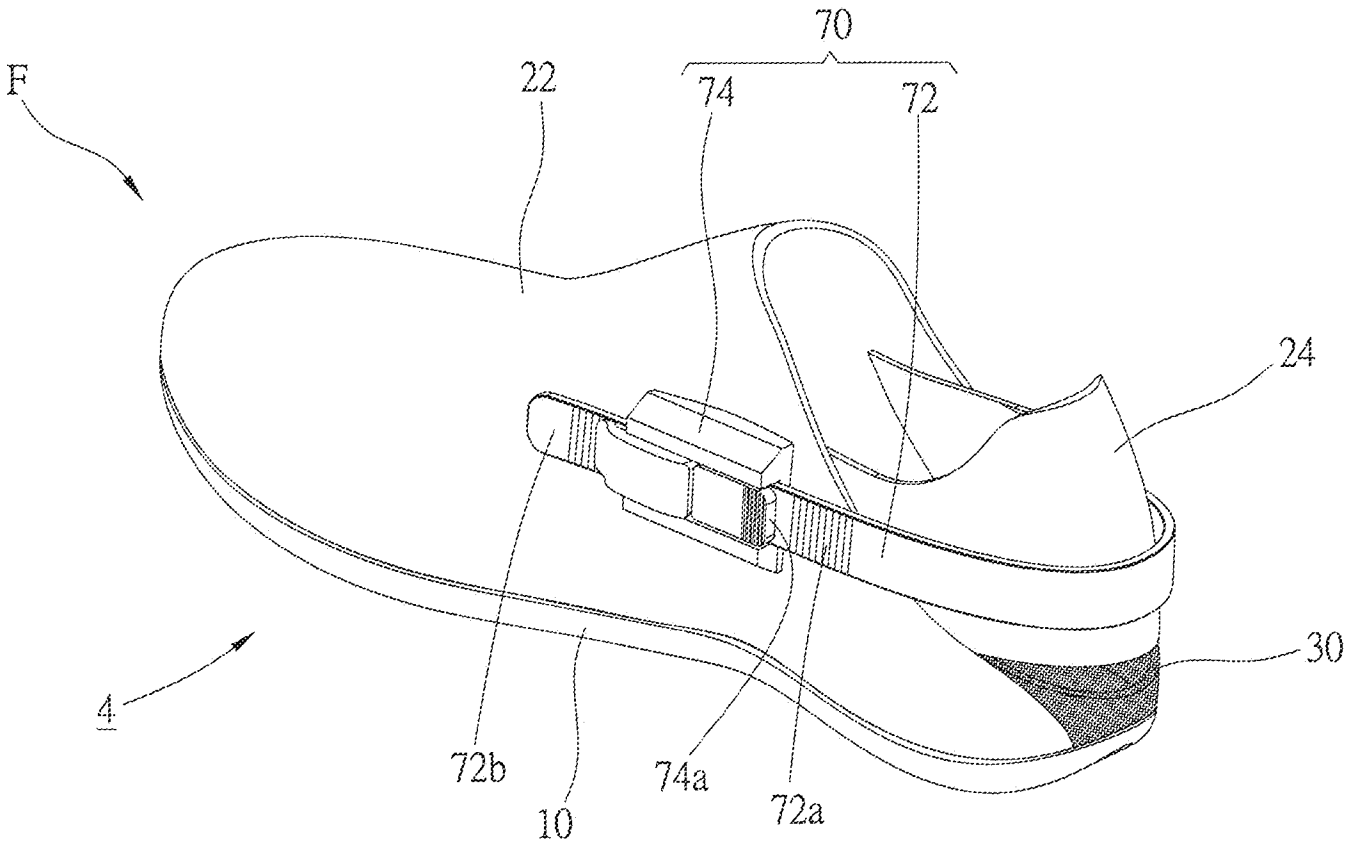
FIG. 9 is a perspective view of a sixth preferred embodiment of the present invention, showing the control device includes a strap and a fixation member.

As shown in FIG. 9, a shoe 4 of a sixth preferred embodiment of the present invention has, again, approximately the same structure mentioned above. However, a control device 70 of the shoe 4 includes a strap 72 and a fixation member 74, wherein the fixation member 74 is provided on the body portion 22 of the upper 20, and has a gap 74*a* which allows the strap 72 to pass through. The strap 72 has a ladder 72*a* thereon, and has an end 72*b* passing through the gap 74*a* of the fixation member 74. The gap 74*a* may tightly hold the strap 72 at different locations thereon. In this way, the strap 72 is adapted to be pulled to move the heel portion 24 relative to the body portion 22 in the axial direction toward the front end F of the shoe 4. Therefore, the length L of the shoe 4 is also adjustable.

Figure 10:
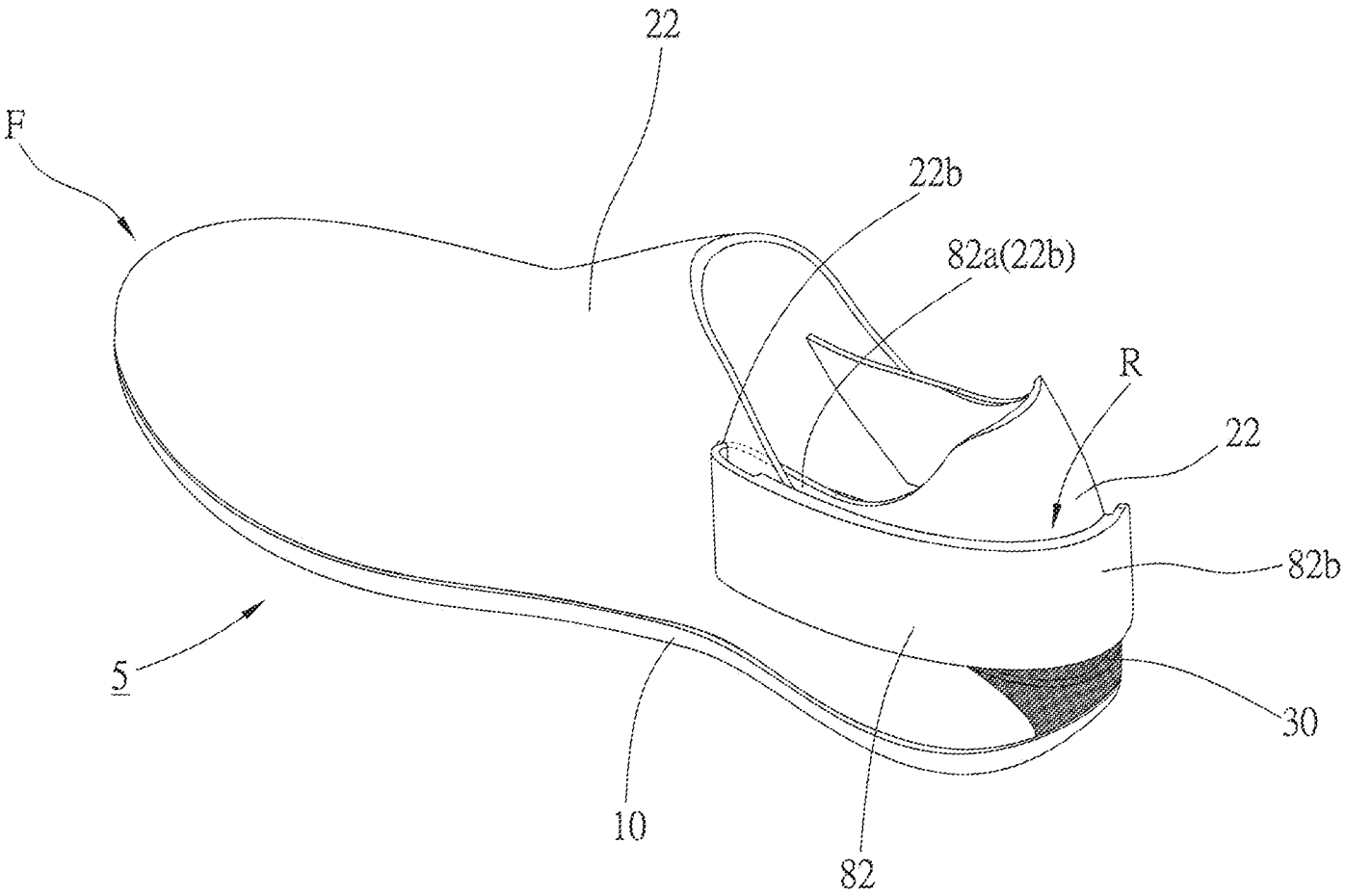
FIG. 10 is a perspective view of a seventh preferred embodiment of the present invention, showing the control device includes a band connected to the rear end.

A shoe 5 of a seventh preferred embodiment of the present invention shown in FIG. 10 is especially suitable for triathlon, wherein a control device 80 of the shoe 5 includes a band 82, which has a first end 82*a* formed by one of the arms 24*a* of the heel portion 24, and a second end 82*b* opposite to the first end 82*a*. The second end 82*b* is detachably affixed to the rear end R of the shoe 5, wherein a portion of the band 82 passes through a slit 22*b* on the body portion 22. The band 82 is also adapted to be pulled to move the heel portion 24 relative to the body portion 22 in the axial direction toward the front end F, and the second end 82*b* can be effectively affixed to and get fixed on the rear end R. In practice, the second end 82*b* may be affixed to the rear end R through hook fasteners and loop fasteners, i.e. Velcro hooks and loops which are respectively provided on the second end 82*b* and the rear end R. Whereby, a wearer may put on the shoe 5, and immediately pull the second end 82*b* to connect it to the rear end R, which adjusts the length L of the shoe 5 to a perfect length in no time. In other words, a wearer may adjust the length L of the shoe 5 extremely quickly, and therefore the shoe 5 can be very helpful for triathlon athletes.

In order to better guide the heel portion 24 to relatively move in the axial direction, at least one elastic band (not shown) can be further included in any shoe 1-5 of the first to the seventh preferred embodiments, wherein the at least one elastic band connects an inner surface of the body portion 22 and the heel portion 24, and it is preferable to have the arms 24*b* of the heel portion 24 connected to the inner surface of the body portion 22 through the at least one elastic band.

In addition, the stretch fabric 30 may be made of at least one member of the group consisting of microfiber, carbon fiber, and plastic in practice. On the other hand, the heel portion 24 may be made of at least one member of the group consisting of carbon fiber, aluminum, fiberglass, and textile in practice.

It must be pointed out that the embodiments described above are only some preferred embodiments of the present invention. All equivalent structures which employ the concepts disclosed in this specification and the appended claims should fall within the scope of the present invention.

What is claimed is:

1. A shoe, of which a length between a front end and a rear end thereof is adjustable, wherein the front end and the rear end are two opposite ends of the shoe, and when a wearer is in the shoe, toes of the wearer are toward the front end, and a heel of the wearer is near the rear end, comprising:

an outsole;

an upper comprising a body portion and a heel portion, which are separated from each other, wherein when the wearer is in the shoe, the body portion covers a bridge of a foot of the wearer, and the heel portion fits around the heel of the wearer; the body portion is directly attached on the outsole; the heel portion has a bottom edge;

a stretch fabric connecting the bottom edge of the heel portion and the outsole; and a control device connecting the body portion and the heel portion of the upper, wherein the control device moves the heel portion relative to the body portion as a whole in an axial direction from the rear end to the front end of the shoe, which makes the heel portion press against the heel of the wearer when the wearer is in the shoe;

wherein the heel portion connects with the stretch fabric only by the bottom edge; a capacity is formed between the body portion of the upper and the outsole, the heel portion has two arms extending in a direction toward the capacity and overlapped by the body portion, two ends of the two arms are inserted into the capacity.

2. The shoe of claim 1, wherein the control device comprises a connecting member and a fastener, wherein the fastener is provided on either the heel portion or the body portion, and the connecting member connects the fastener and the heel portion or the body portion which is not provided with the fastener; the fastener is adapted to move the heel portion relative to the body portion in the axial direction toward the front end through the connecting member.

3. The shoe of claim 2, wherein the fastener is provided on the heel portion; the connecting member connects the fastener and the body portion.

4. The shoe of claim 2, wherein the fastener is provided on the body portion; the connecting member connects the fastener and the heel portion.

5. The shoe of claim 2, wherein the fastener is a cable dial, and the connecting member is a cable.

6. The shoe of claim 1, wherein the control device comprises a strap and a fixation member; the fixation member is provided on the body portion of the upper, and has a gap which allows the strap to pass through; the strap has a ladder thereon, and has two opposite ends; one end of the strap is fixed on the heel portion of the upper, and the other end thereof passes through the gap of the fixation member; the gap of the fixation member tightly holds the strap at different locations thereon; the strap is adapted to be pulled to move the heel portion relative to the body portion in the axial direction toward the front end.

7. The shoe of claim 1, wherein the control device comprises a shoe lace; the body portion and the heel portion respectively have a plurality of perforations thereon for the shoe lace to thread through; the shoe lace is adapted to be pulled and tied to move the heel portion relative to the body portion in the axial direction toward the front end.

8. The shoe of claim 1, wherein the control device comprises a band having a first end fixed on the heel portion, and an opposite second end passing through a slit on the body portion of the upper to be affixed to the first end; the band is adapted to be pulled to move the heel portion relative to the body portion in the axial direction toward the front end.

9. The shoe of claim 8, wherein the first and the second ends are respectively provided with hook fasteners and loop fasteners.

10. The shoe of claim 1, wherein the control device comprises a band having a first end fixed on the heel portion, and an opposite second end passing through a slit on the body portion of the upper to be affixed to the rear end of the shoe; the band is adapted to be pulled to move the heel portion relative to the body portion in the axial direction toward the front end.

11. The shoe of claim 10, wherein the second end and the rear end of the shoe are respectively provided with hook fasteners and loop fasteners.

12. The shoe of claim 1, wherein the stretch fabric is made of at least one member of the group consisting of microfiber, carbon fiber, and plastic.

13. The shoe of claim 1, wherein the heel portion is made of at least one member of the group consisting of carbon fiber, aluminum, fiberglass, and textile.

* * * * *